United States Patent [19]

Schiff

[11] 3,968,151

[45] July 6, 1976

[54] ASHLESS DISPERSANT PRODUCTS AND PROCESS

[75] Inventor: Sidney Schiff, Bartlesville, Okla.

[73] Assignee: Phillips Petroleum Company, Bartlesville, Okla.

[22] Filed: May 12, 1975

[21] Appl. No.: 576,939

Related U.S. Application Data

[62] Division of Ser. No. 503,946, Sept. 6, 1974, Pat. No. 3,919,094.

[52] U.S. Cl. ..... 260/501.2

[51] Int. Cl.[2] ..... C07C 87/123; C07C 87/20; C07C 109/08; C07C 145/02

[58] Field of Search ..... 260/501.2

[56] References Cited

UNITED STATES PATENTS

| | | | |
|---|---|---|---|
| 2,264,894 | 12/1941 | Shoemaker et al. | 44/73 |
| 2,721,843 | 10/1955 | Palmer, Jr. | 252/33 |
| 3,043,783 | 7/1962 | Hatcher et al. | 44/73 |
| 3,438,898 | 4/1969 | Schlobolm et al. | 252/33 |
| 3,441,369 | 4/1969 | McCoy et al. | 260/96.5 R |

*Primary Examiner*—Daniel E. Wyman
*Assistant Examiner*—Y. Harris-Smith

[57] ABSTRACT

Improved additives for lubricants and motor fuels are provided by reacting a petroleum sulfonic acid with an adduct formed from an amine and an aldehyde. Lubricating oil compositions and motor fuels containing said additives are also provided.

10 Claims, No Drawings

ASHLESS DISPERSANT PRODUCTS AND PROCESS

This is a divisional application of application Ser. No. 503,946, filed Sept. 6, 1974, entitled "Additives for Lubricants and Motor Fuels," now U.S. Pat. No. 3,919,094.

This invention relates to improved additives for lubricants and motor fuels. In one aspect, this invention relates to the preparation of novel compositions of matter formed from petroleum sulfonic acids and an adduct formed from an amine and an aldehyde. In accordance with another aspect, this invention relates to lubricant compositions containing as an additive the reaction product formed from a petroleum sulfonic acid and an adduct from an amine and an aldehyde. In accordance with another aspect, this invention relates to motor fuel compositions containing as an additive the reaction product formed by contacting a petroleum sulfonic acid with an adduct of an amine and an aldehye.

At the present time it is common practice to enhance or modify certain of the properties of lubricating oils through the use of various additives or improvement agents. The lubricating oils employed in internal combustion engines, such as automotive, light aircraft, and diesel engines, in particular, require the use of additive agents to render them serviceable under the adverse environmental conditions frequently encountered in the operation of these engines. Among the various additives employed in modern engine oils, one of the most important is the type which acts to prevent accumulation of sludge in the crankcase and on the cylinder walls, thereby preventing sticking of the piston rings, and the formation of varnish-like coating on the pistons and cylinder walls. Because of their general function of maintaining a clean engine, additives of this nature are termed "detergents" although it is now understood that they have little utility in cleaning a dirty engine but by virtue of dispersant activity prevent or greatly retard engine fouling.

As cleanliness requirements have called for greater concentrations of detergent additives, the problem of ash deposition in the combustion chamber has become more serious. Especially is this a problem in certain engines which tend to develop violent preignition troubles in the presence of metal-containing ash. These problems have increased the importance and desirability of using "ashless" detergents.

An ashless detergent is one which shows substantially no ash when tested by ASTM procedure D-482-59%. The only possible source of metal when using such an additive is that of corrosion products and trace quantities present in some crude oils. It can be generally stated that metal-containing deposits in an engine (1) contribute to valve burning, (2) contribute to preignition, (3) tend to foul and short-out spark plugs, and (4) tend to increase octane requirements. Use of conventional metal-containing detergents can contribute to the deposit of metal-containing materials in the combustion chamber. Metal-containing deposits do not form from ashless detergents. Use of an ashless detergent, therefore, materially reduces the problems normally encountered in internal combustion engines in connection with metal-containing deposits.

It has been found that reaction products having improved detergent and dispersant properties can be prepared by reacting a petroleum sulfonic acid with an adduct formed from at least one amine and at least one aldehyde. Thus, broadly speaking, the present invention resides in the reaction product or products obtained when a petroleum sulfonic acid is reacted with an adduct formed from at least one amine and at least one aldehyde as new additives for lubricants and motor fuels; methods of preparing said new additives; and lubricant and motor fuel compositions containing said new additives.

An object of this invention is to provide an ashless additive for lubricants.

Another object of this invention is to provide improved additives exhibiting reduced deposit-forming tendencies in motor fuels.

Another object of this invention is to provide a method for the preparation of additives for lubricating oils and motor fuels.

Another object of this invention is to provide an improved lubricating composition utilizing the additives of the invention.

Another object of this invention is to provide improved motor fuel compositions utilizing the additives of the invention.

Other aspects, objects, and advantages of the invention will be apparent to those skilled in the art upon studying this disclosure.

Thus, according to the invention, there is provided new compositions of matter comprising the oil-soluble reaction product or products obtained upon reacting a petroleum sulfonic acid with an adduct formed from at least one amine and at least one aldehyde.

Further according to the invention, there is provided a process for producing an additive for lubricants and motor fuels which process comprises forming an adduct from at least one amine and at least one aldehyde, and then reacting the adduct thus formed with a petroleum sulfonic acid to form said additive.

Further according to the invention, there is provided as a new additive for lubricants and motor fuels a product additive obtained by the process described in the preceding paragraph.

Still further, according to the invention, there is provided new lubricating oil compositions comprising a major proportion of a lubricating oil base stock and a minor proportion of a new additive in accordance with the invention.

Still further, according to the invention, there is provided a new motor fuel composition comprising a major proportion of a motor fuel and a minor proportion of a new additive in accordance with the invention.

A wide variety of reaction conditions can be employed in the practice of the invention. Any reaction conditions under which the reactions involved in the invention will take place are within the scope of the invention. Similarly, any proportions of reactants which will react with each other to produce a product additive of the invention are within the scope of the invention. However, as will be understood by those skilled in the art in view of this disclosure, certain reaction conditions and reactant proportions are favored for economic reasons, i.e., the reactions proceed faster and give greater yields for some reaction conditions and some proportions of reactants. The reaction or reactions involved in preparing the product additives of the invention can be carried out in the presence or absence of a diluent which is chemically inert, i.e., does not react with the reactants or reaction products.

Generally speaking, in the practice of the invention the petroleum sulfonic acid and amine/aldehyde adduct are preferably reacted in amounts ranging from 1/1 to 5/1 equivalents of petroleum sulfonic acid/mole of amine used to prepare the adduct. A preferred range is 1.5/1 to 3.5/1. Generally speaking, sufficient petroleum sulfonic acid is used with the amine adduct to obtain a hydrocarbon-soluble reaction product. However, it is within the scope of the invention to employ operable ratios of sulfonic acid to adduct outside said ranges.

The reaction of said adduct and said petroleum sulfonic acid can be carried out at any temperature at which the reaction(s) involved will proceed. Generally speaking, said reaction is preferably carried out at temperatures within the range of from about 100° to about 200°F. However, it is presently preferred to employ temperatures in the range of 140° to 150°F although it is within the scope of the invention to employ operable temperatures outside said ranges.

A wide range of reaction times can be employed in the practice of the invention. Generally speaking, the reaction times employed for the reaction of said reactants will be within the range of from about 0.1 to about 20 hours. However, it is within the scope of the invention to employ operable times outside said ranges. The reaction can be conducted at any pressure, such as atmospheric pressure, suitable for carrying out the reactions involved.

It is currently preferred to contact the reactants in the presence of an inert diluent, the most preferred of which is a SAE 10 largely paraffinic lubricating oil base stock in amounts ranging from 0.2/1 to 10/1 parts by weight diluent per part by weight petroleum sulfonic acid. It is likewise currently preferred to add a solution of petroleum sulfonic acid in SAE 10 stock oil (approximately 60 weight percent petroleum sulfonic acid) slowly to a rapidly stirred dispersion of amine/aldehyde adduct in SAE 10 stock oil (approximately 30 weight percent adduct) while maintaining the temperature of the reaction system at 140° to 150°F.

If the currently preferred reaction conditions are employed, no further isolation or purification steps are necessary in order to use the product in gasoline or lubricating oil formulations. It is currently preferred to employ the crude reaction mixture for such purposes as described above without subsequent treatment. In some cases, however, it may be desirable to isolate and purify the product. Such may be accomplished by any methods currently known in the art, such as fractional crystallization, solvent extraction, etc.

Generally speaking, any petroleum sulfonic acid prepared in accordance with methods known in the art can be used as a starting reagent in the practice of the invention. Methods disclosed in U.S. Pat. No. 3,135,693, issued June 2, 1964, to W. B. Whitney et al., are exemplary of methods which can be used in preparing sulfonic acids which can be used in the practice of this invention.

A wide variety of oils can be used as the charge oil in preparing the petroleum sulfonic acids used in the practice of the invention. Preferably, said charge oil is selected from more viscous bright stock fractions of petroleum. A petroleum fraction having a viscosity of at least 90 SUS at 210° F will produce a petroleum sulfonic acid which is satisfactory in many instances. The deasphalted and solvent refined petroleum fractions having a viscosity of about 140 to about 270 SUS at 210°F are preferred. A presently more preferred sulfonation charge stock is a propane fractionated, solvent extracted, and dewaxed Mid-Continent oil of about 200 to about 230 SUS at 210°F. It is preferred that the sulfonation charge stock have a viscosity index of about 85 to 100, or even higher.

A Mid-Continent oil is more precisely defined as a mixed base or intermediate base oil in "The Science of Petroleum," Volume 1, page 7, Oxford University Press, London, New York and Toronto, 1938. The base of a crude petroleum is defined therein as follows: "The 'base' of a crude petroleum is descriptive of the chemical nature of its main constituents. A petroleum may be described as paraffin base, asphalt base, or mixed base (intermediate base), according as paraffin wax, asphalt, or both paraffin wax and asphalt are present in the residue after distillation of the lighter components. Typical representatives of these three classes are Pennsylvania, Mexican, and Mid-Continent petroleums, respectively."

The residual material discarded from the propane fractionation step contains the rejected asphalt and more aromatic oils. The lube oil fraction, recovered in a propane fractionation step after removal of the SAE 50 lube stock, is extracted with a selective solvent which will separate the paraffinic hydrocarbons from the more aromatic-type hydrocarbons for removal of these more aromatic-type hydrocarbons to prepare the preferred feedstock. The raffinate from the solvent extraction step is then dewaxed.

Sulfonating agents which are known to the art can be utilized in the sulfonation step in preparing said petroleum sulfonic acids. Sulfonating agents which can be so used include fuming sulfuric acid and liquid $SO_3$. Said fuming sulfuric acid can vary from 10 weight percent to 40 weight percent excess $SO_3$. However, when sulfuric acid is used it is usually preferred to use commercial fuming sulfuric acid which contains about 20 weight percent excess $SO_3$. Liquid $SO_3$, i.e., liquid $SO_3$ in liquid $SO_2$, is the presently preferred sulfonating agent for use in the practice of the invention. Such liquid $SO_3$ is commercially available.

When 20 percent fuming sulfuric acid is used as the sulfonating agent, the acid-oil ratio can be in the range of from about 0.1:1 to about 0.7:1, or even 1:1 to produce the petroleum sulfonic acids used in the practice of the invention. A preferred range of acid-oil ratios is in the range of about 0.3 to about 0.6:1. When liquid $SO_3$ in liquid $SO_2$ is the sulfonation agent, the $SO_3$ to oil weight ratios are maintained equivalent to those available from the 20 percent fuming sulfuric acid values given above. In other words, the $SO_3$ to oil ratio can be in the range of about 0.02 to 0.2, preferably about 0.06 to about 0.12:1. Said $SO_3$ to oil ratios can be controlled by varying the rate of flow of the oil or of the $SO_3$-containing medium, or both. The above given ratios are weight ratios.

Sulfonation temperatures can be controlled within the range of about 50° to about 200°F with the preferred operating range being between about 80° and about 150°F. At temperatures above about 200°F, excessive oxidation with liberation of sulfur dioxide may take place. A reaction time of about 20 to about 90 minutes is preferred when fuming sulfuric acid is utilized as the sulfonating agent in order to provide optimum yield and quality of products. When sulfur trioxide, e.g., sulfur trioxide in sulfur dioxide, is utilized as the sulfonation agent, the reaction rate is greatly accelerated and the reaction has been found to be substantially completed in the time required to accomplish suitable contact of the oil with the sulfur trioxide, usually less than about five minutes.

The sulfonation reaction can be carried out at atmospheric pressure although pressures greater or less than atmospheric also can be employed, if desired. When using liquid $SO_3$ in liquid $SO_2$ as the sulfonating agent, it is preferred to carry out the reaction at sufficient pressure to maintain the $SO_2$ in liquid phase.

As indicated hereinbefore, the above-described petroleum sulfonic acids are reacted with an adduct formed from at least one amine and at least one aldehyde to produce the product additives of the invention.

A wide variety of amines can be used in the practice of the invention. Presently preferred amines for use in the practice of the invention include (a) those containing from 2 to 12 carbon atoms per molecule and represented by the formula $RNH_2$ wherein R is alkyl, cycloalkyl, aryl, alkaryl, aralkyl, alkylcycloalkyl, cycloalkylalkyl, cycloalkylaryl, or arylcycloalkyl and (b) those polyamines represented by the formula $H_2N[(CH_2)_xNH]_yH$ wherein $x$ is a whole integer of from 2 to 6, inclusive, and $y$ is a whole integer of from 1 to 10, inclusive. Examples of suitable amines which can be used in the practice of the invention include, among others, the following: ethylamine, butylamine, 3-methylcyclopentylamine, decylamine, dodecylamine, cyclohexylamine, aniline, naphthylamine, 3,5-diethylcyclohexylamine, m-toluidine, 2,3-xylidine, benzylamine, 3-cyclohexylbutylamine, p-cyclohexylaniline, 4-phenylcyclohexylamine, 3-methyl-4-phenylcyclopentylamine, ethylenediamine, and its homologs, diethylenetriamine, triethylenetetramine, tetraethylenepentamine, dipropylenetriamine, butylenediamine, hexamethylenediamine, tetrahexenepentamine, heptabutyleneoctamine, decapenteneundecamine, and the like.

Aldehydes generally corresponding to the formula

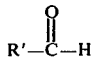

and containing from 2 to 12 carbon atoms per molecule are useful in this invention. Each R′ is a radical selected from hydrocarbyl, hydroxyhydrocarbyl, hydrocarbyloxyhydrocarbyl, halohydrocarbyl, hydrocarbylthiohydrocarbyl, and mercaptohydrocabyl wherein the term "hydrocarbyl" describes the radicals alkyl, cycloalkyl, aryl, or combinations of these such as aralkyl, or alkaryl, and the like. R′ is preferably a hydrocarbyl, hydroxyhydrocarbyl, or a hydrocarbyloxyhydrocarbyl radical. Examples of aldehydes which are within the scope of this invention include acetaldehyde, butyraldehyde, valeraldehyde, dodecylaldehyde, benzaldehyde, p-tolualdehyde, α-tolualdehyde, cyclohexylaldehyde, p-anisaldehyde, 4-cyclopentylbutyraldehyde, salicylaldehyde, p-chlorobenzaldehyde, o-mercaptobenzaldehyde, 2,2,3-trichlorobutanal, p-(methylthio)benzaldehyde, and the like. Valeraldehyde, salicylaldehyde, and p-anisaldehyde are especially preferred aldehydes.

The adducts of the above-described aldehydes with amines are prepared by contacting the reactants in amounts ranging from about 1/1 to about 2/1 moles of aldehyde per mole of amine. A preferred range is from 1/1 to about 1.25/1. Said contacting is done under any suitable conditions of time, temperature, and pressure which result in the desired product. It is currently preferred to add the aldehyde to the amine slowly with stirring while cooling the reaction mixture to temperatures as low as about 0°F. The reaction mixture can then be refluxed at temperatures up to about 350°F to complete the reaction and to distill some of the water formed in the reaction. The total reaction time can range from about 0.1 to about 20 hours. The product can then be purified by conventional means, such as solvent extraction, fractional distillation, azeotropic distillation, addition of a drying agent such as potassium hydroxide, etc., but it is preferable to use the crude reaction mixture without further purification.

It is sometimes desirable to pressurize the reactor with an inert gas to maintain the adduct forming reactants predominantly in the liquid phase, for example, from 0 to about 2000 psig.

On occasion, it is desirable to employ an inert diluent in the production of the adduct of the amine and aldehyde. Such diluents include saturated aliphatic and cycloaliphatic hydrocarbons, aromatic hydrocarbons, etc. The presently preferred mode of operation is in the absence of diluent.

While it will be immediately evident to one skilled in the art that the reaction of aldehydes with amines produces predominantly imines, the scope of this invention encompasses the products, mixtures of products or crude reaction mixtures obtained by contacting under appropriate conditions the above-described aldehydes and amines.

The adduct of the amine and aldehyde can be isolated and purified by any convenient means, such as fractional distillation, crystallization, solvent extraction, etc. However, it is currently preferred to employ the crude reaction mixture for contacting with the petroleum sulfonic acid to produce the inventive composition.

The compositions of this invention, when used as a gasoline additive, are added directly to gasoline in either a purified state or as a crude reaction mixture as hereinbefore described. The quantity of additive utilized is in the range of 0.001 to 0.2, preferably 0.01 to 0.1, parts by weight additive per 100 parts by weight gasoline. When gasoline containing this additive is utilized in conventional internal combusion engines, the buildup of hard refractory deposits on intake valves is substantially diminished. In addition, the additive in gasoline is effective as an upper cylinder lubricant, a carburetor cleaner, a solvent for valve deposits, and a fuel line cleaner.

The gasolines into which the invention additives are dispersed are conventional motor fuel distillates boiling in the range of 70°–420°F. Gasolines or automotive fuels to which the described additives perform the functions described include substantially all grades of gasoline presently being employed in automotive and internal combustion aircraft engines. Generally, automotive and aircraft gasolines contain both straight-run and cracked stock with or without alkylated hydrocarbons, reformed hydrocarbons, and the like. Such gasolines can be prepared from saturated hydrocarbons, e.g., straight-run stocks, alkylation products, and the like, with or without gum inhibitors and with or without soluble lead compounds as, for example, tetraethyl lead (T.E.L.) or ethyl fluid. The gasolines may contain as much as about 5 ml of T.E.L. per gallon, such amounts being used commercially in aviation gasolines. These can be leaded or non-leaded and can contain other conventional fuel additives such as antioxidants and the like.

The compositions of this invention are oil-soluble and can be incorporated in lubricating oil formulations in combinations depending on specific service requirements. For example, in many general duty crankcase oil applications, the additives of the invention can be blended with appropriate base oils and other additives to provide high quality lubricating oils which meet the requirements and specifications for their intended use.

Generally speaking, the compositions of this invention can be added to the base lubricating oil in any amount sufficient to produce the desired degree of improvement. For example, the additives can be used in amounts ranging from 0.2 to 30 weight percent of the finished oil. A presently preferred concentration of petroleum sulfonic acid addition product is in the range of about 1 to 15 weight percent of finished oil.

The lubricating oils to which the invention compositions can be added include any suitable mineral oils of lubricating viscosity, such as those used for compounding lubricating oils of SAE 10 to SAE 50 viscosity. These oils can be derived from suitable naphthenic, paraffinic, and mixed base crudes. The lube oils can also contain other additives such as thickeners and the like.

EXAMPLE I

In Run 1 a petroleum sulfonic acid was prepared from a solventrefined, dewaxed lubricating oil fraction-derived from Mid-Continent petroleum and having the following properties: viscosity of about 4200 SUS at 100°F and about 210 SUS at 210°F and viscosity index of about 97. This oil was sulfonated with a ten percent $SO_3$-90 percent $SO_2$ mixture in a continuous operation substantially like that described by Whitney et al, U.S. Pat. No. 3,135,693. The $SO_3$/oil weight ratio was about 0.08, and the temperature of the reaction was controlled at about 115° F. The total reaction time, including mixing and soaking periods, was about five minutes. The system was maintained in liquid phase at a pressure of 100 to 120 psig. Effluent from the sulfonation unit was subjected to a two-stage flash for $SO_3$—$SO_2$ removal.

EXAMPLES II TO VII

The following runs illustrate the preparation of adducts of tetraethylenepentamine (TEPA) and either salicylaldehyde, valeraldehyde or p-anisaldehyde.

The general method of preparation of the adducts is illustrated by Run 2 in which the reaction product of TEPA and salicylaldehyde was prepared.

Run 2 was conducted in a 250 ml reactor equipped with a condenser, stirrer and addition funnel and cooled by partial immersion in an ice-water bath. To 47.5 gm of stirred TEPA in the reactor, 30.5 gm salicylaldehyde was added through the addition funnel over a 45-minute interval. Following completion of the aldehyde addition, the stirring at ice-water temperature was continued for fifteen minutes, after which the reaction mixture was refluxed for 1.5 hours. Elemental analyses of the crude reaction product are tabulated in Table I.

Run 3 was conducted as described for Run 2 except that double amounts of reactants and a 500 ml reactor were used. Addition of salicylaldehyde required 1.25 hours. Following refluxing at about 268°F, the reaction mixture was cooled to 100°F, 200 ml of benzene was added, and mixture was heated to azeotropically distill a benzene-water mixture. Following distillation of benzene the reaction mixture was heated to 190°F with a stream of nitrogen bubbling through the mixture to remove residual water. Crude reaction mixture (145.8 gm) was retained as product. Elemental analyses are recorded in Table I.

Run 4 was conducted in the reactor described for Run 2 using 95 gm TEPA and 43 gm valeraldehyde. Addition of the valeraldehyde to the stirred TEPA cooled in an ice-water bath required 1.75 hour, after which stirring continued at that temperature for an additional 15 minutes. A 70 ml aliquot of the reaction mixture was refluxed for 1.5 hours. Elemental analyses of the crude product are recorded in Table I.

In Run 5 the remainder of the reaction mixture from Run 4 following removal of the 70 ml aliquot was used. To said remaining reaction mixture was added a small amount of potassium hydroxide. After one minute stirring, the mixture was allowed to stand overnight at about 0°C. Decantation of the upper liquid layer and fractional distillation thereof gave product (b.p. 176°–250°C at 25 torr), the elemental analyses of which are recorded in Table I.

Run 6 was conducted in the reactor described for Run 2 using 47.5 gm TEPA and 34 gm p-anisaldehye. Dropwise addition of aldehyde to the stirred TEPA cooled in an ice-water bath required one hour, after which stirring continued at that temperature for fifteen additional minutes. Refluxing the reaction mixture for 1.5 hours gave crude reaction mixture, the elemental analyses of which are tabulated in Table I.

Run 7 was conducted as described for Run 6 except that the reflux step was omitted and the reaction mixture was then stirred with a small amount of potassium hydroxide for one minute and allowed to stand over potassium hydroxide overnight at 0°C. Decantation of the resulting upper liquid layer and fractional distillation thereof gave product boiling at 167° to 190°C at 13 torr. Elemental analyses of the product are tabulated in Table I.

TABLE I

| Run No. | Starting Aldehyde | Treatment | Elemental Analyses %C | %H | %N | %O |
|---|---|---|---|---|---|---|
| 2 | Salicyl- | Reflux | ND[a] | ND | ND | 9.91 |
| 3 | Salicyl- | Benzene & $N_2$ | 62.68 | 7.49 | 22.17 | 6.30 |
| Theory[b] | | | 61.40 | 9.28 | 23.87 | 5.45 |
| 4 | Valer- | Reflux | 58.2 | 11.6 | 24.1 | ND |
| Theory[c] | | | 57.6 | 11.1 | 25.5 | 5.8 |
| 5 | Valer- | KOH & dist. | 59.32 | 11.94 | 27.81 | ND |
| Theory[d] | | | 60.65 | 12.14 | 27.21 | 0 |
| 6 | p-Anis- | Reflux | 61.14 | 9.35 | 21.22 | 8.87 |
| Theory[e] | | | 59.04 | 9.60 | 21.52 | 9.83 |
| 7 | p-Anis- | KOH & dist. | 55.07 | 10.43 | 30.73 | 3.54[f] |
| | | | 59.92 | 10.28 | 27.77 | 3.78[f] |

TABLE I-continued

| Run No. | Starting Aldehyde | Treatment | Elemental Analyses %C | %H | %N | %O |
|---|---|---|---|---|---|---|
| Theory[e] | | | 62.50 | 9.51 | 22.77 | 5.20 |

[a]Not determined.
[b]Calculated for imine $C_{18}H_{27}N_3O$.
[c]Calculated for starting mixture.
[d]Calculated for imine $C_{13}H_{31}N_5$.
[e]Calculated for imine $C_{16}H_{29}N_3O$.
[f]Elemental analyses of individual fractions.

EXAMPLE VIII

The following run illustrates the reaction of the petroleum sulfonic acid of Run 1 with the amine/-salicylaldehyde adduct of Run 3. The usefulness of the product as an additive for motor fuels and lubricating oils is also demonstrated.

In Run 8 in a 3-liter reactor were mixed 65 gm of salicylaldehyde/TEPA adduct from Run 3 and 390 gm SAE 10 stock oil. To the stirred suspension heated to 145°F was added 1430 ml of a solution consisting of 58.86 weight percent petroleum sulfonic acid in SAE 10 stock oil, said solution having previously been blown with nitrogen. Addition of the petroleum sulfonic acid solution required 70 minutes during which the temperature of the reaction system was maintained at 145°F and after which stirring and temperature of 145°F were maintained for an additional 30 minutes. The crude reaction mixture contained 0.8 percent sulfur and 0.6 percent nitrogen and exhibited a pH of 6.35.

This product was rated excellent when submitted to a carbon spot dispersancy test. A carbon spot dispersancy test is conducted by stirring 50 mg of carbon black into 10 gm of an oil blend containing 4 weight percent of the candidate additive. A drop of the resulting slurry is then dropped onto a polished Burns Block heated to a temperature of 500°F. The extent to which the carbon black is carried to the extremity of the resulting oil ring is a measure of the dispersancy characteristics of the additive.

The product of this run was also compounded into a commercial oil formulation and subjected to a standard automotive Ford Sequence VB test (described in ASTM Special Technical Publication No. 315-C) and compared to the SAE requirements (1973 SAE Handbook, Sec. J-183a, "SAE Recommended Practice for Engine Oil Performance," pp. 417–419) for a lubricating oil. The results are tabulated in Table II.

TABLE II

| | Lube Oil[a] With Additive | SAE Requirements |
|---|---|---|
| Overall Sludge (50=clean) | 38.7 | 42.5 |
| Overall Varnish (50=clean) | 32.9 | 41.0 |
| Piston Varnish (10=clean) | 8.2 | 8.0 |
| Oil Screen Plugging, % | 0 | 5[b] |
| Oil Ring Plugging, % | 0 | 5[b] |

[a]A commercial SAE 10W-40 motor oil formulation containing calcium petroleum sulfonate, oxidation inhibitor and viscosity index improver. This test formulation contained 12 weight percent of the additive of Run 8 in place of the normally used commercial dispersant.
[b]Maximum values.

These data show that the invention additive equalled or surpassed the SAE requirement in three of the five test categories. Overall sludge and overall varnish were below standard.

A carburetor detergency test was carried out to test the crude reaction mixture of Run 8 as a motor fuel additive. Briefly, the test procedure involved use of the test gasoline in 170-cubic inch displacement 6-cylinder automobile engine with a removable carburetor throat insert. Operation of the engine was for 23 continuous hours at 1800 rpm and 11.4 brake horsepower. The removable insert was washed with n-heptane after the engine operation and was weighed to give the weight of deposits formed. The base gasoline was a commercial leaded gasoline. The results obtained using the base gasoline with and without the invention additive are given in Table III.

TABLE III

| Fuel | Deposits (mg) |
|---|---|
| Neat Fuel | 17 |
| Fuel with additive[a] | 13.6 |

[a]Fuel contained 10 PTB (pounds per thousand barrels) of the crude reaction mixture of Run 8.

These results show reduced deposit formation using this invention composition as a gasoline additive.

EXAMPLE IX

The following run illustrates the reaction of the petroleum sulfonic acid of Run 1 with the amine/-valeraldehyde adduct of Run 4. The usefulness of the product as an additive for motor fuels and lubricating oils is also demonstrated.

In Run 9 in a 500 ml reactor were mixed 7.8 gm of crude reaction mixture from Run 4 and 10 gm SAE 10 stock oil. To the stirred suspension heated to 145°F was added in increments a solution consisting of 58.86 weight percent petroleum sulfonic acid in SAE 10 stock oil, said solution having previously been blown with nitrogen. After each increment of acid oil was added and the reaction mixture stirred for 15 minutes, a 10 ml aliquot was removed from the reaction system for carbon spot dispersancy test (as described in Example VIII) and pH measurement. The results are tabulated in Table IV.

TABLE IV

| Total Petroleum Sulfonic Acid Added, ml | Acid/Amine Ratio[a] | Carbon Spot Test | pH |
|---|---|---|---|
| 25 | 0.224 | ND[b] | 9.3 |
| 50 | 0.511 | Fair | 9.3 |
| 100 | 1.20 | ND | 8.9 |
| 150 | 1.97 | Excellent | 7.7 |
| 200 | 2.79 | ND | 5.4 |
| 250 | 3.66 | Excellent | 3.4 |

[a]Equivalents of petroleum sulfonic acid added per mole of original TEPA.
[b]Not determined.

The aliquot, removed after a total of 150 ml of petroleum sulfonic acid solution was added, was tested as a gasoline additive in a laboratory gasoline deposit test. The raw gasoline stock for this test was a commercial automotive premium gasoline containing tetraethyl lead and oxidation inhibitor but no other additives. The raw gasoline stock was passed through a 0.3 micron filter after which 0.04 parts by weight sulfurized terpene per 100 parts by weight filtrate was added. This procedure produced the gasoline source from which samples were taken for testing with and without the additives of this invention.

The test procedure utilized was a modification of the method described in "A Bench Technique for Evaluating the Induction System Deposit Tendencies of Motor Gasolines," A.A. Johnston and E. Dimitroff (Society of Automotive Engineers, Fuels and Lubricants Meeting, Houston, Tex., Nov. 1–3, 1966, Paper No. 660783).

Briefly, in accordance with above modified procedure, the test gasoline (2 ml/min) was mixed with a flow of air (28 $ft^3$/hr) to form a gasoline-air mixture. The mixture was discharged from a nozzle as a spray against an aluminum deposit pan of known weight. The deposit pan which was preheated to 375°F was maintained at that temperature while the mixture was sprayed against it. After 250 ml of test gasoline was sprayed, the gasoline flow was terminated, but the airflow and temperature were maintained constant for another fifteen minutes. The airflow was then terminated and the pan was allowed to cool to room temperature. Weighing of the pan then provided the weight of deposits in milligrams per 100 ml of test gasoline.

Results obtained using the above-described test on the base gasoline stock without and with 0.05 weight percent crude reaction mixture (that aliquot removed after 150 ml total petroleum sulfonic acid solution was added in Run 9) are given in Table V.

TABLE V

| Fuel | Deposits (mg) |
|---|---|
| Without additive | 1.5 |
| With additive | 0 |

The above data show the reduced deposit formation using this invention composition as a fuel additive and the excellent dispersant properties obtained using this invention composition as a lubricating oil additive.

EXAMPLE X

The following run illustrates the reaction of the petroleum sulfonic acid of Run 1 with the amine/p-anisaldehyde adduct of Run 6. The usefulness of the product as an additive for motor fuels and lubricating oils is also demonstrated.

Run 10 was conducted using the same procedure as described for Run 9 with the only difference being the use of 7.8 gm of the crude reaction mixture from Run 6 in place of that from Run 4. The results are tabulated in Table VI.

TABLE VI

| Total Petroleum Sulfonic Acid Added, ml | Acid/Amine Ratio[a] | Carbon Spot Test | pH |
|---|---|---|---|
| 25 | 0.264 | ND[b] | 9.3 |
| 50 | 0.603 | Fair | 8.9 |
| 100 | 1.42 | ND | 8.0 |
| 150 | 2.32 | Excellent+ | 5.0 |
| 200 | 3.30 | ND | 1.8 |
| 250 | 4.33 | Excellent | 1.7 |

[a]Equivalents of petroleum sulfonic acid added per mole of original TEPA.
[b]Not determined.

The aliquot removed after a total of 150 ml of petroleum sulfonic acid solution was added was tested as a gasoline additive in the laboratory gasoline deposit test described in Example IX. Results obtained using the base gasoline stock without or with 0.05 weight percent crude reaction mixture (that aliquot removed from the total reaction mixture after 150 ml total petroleum sulfonic acid solution was added in Run 10) are given in Table VII.

TABLE VII

| Fuel | Deposits (mg) |
|---|---|
| Without additive | 1.5 |
| With additive | 0.2 |

The above data show the excellent dispersant properties obtained using this invention composition as a lubricating oil additive and the reduced deposit formation using it as a fuel additive.

I claim:

1. As a new composition of matter, the oil-soluble reaction product obtained upon reacting for a time and under conditions of temperature and pressure to produce said reaction product a. a petroleum sulfonic acid with b. an adduct formed from 1. at least one amine selected from primary monoamines having from 2 to 10, inclusive, carbon atoms, and polyamines represented by the formula $H_2N[(CH_2)_xNH]_yH$ wherein $x$ is an integer of from 2 to 6 and $y$ is an integer of from 1 to 10 and 2. at least one aldehyde having from 2 to 12, inclusive, carbon atoms.

2. A composition according to claim 1 wherein (a) is a petroleum sulfonic acid prepared by sulfonating a petroleum hydrocarbon fraction having a viscosity within the range of 90 to 270 SUS at 210°F and a viscosity index of at least about 85 and (b) is an adduct formed from tetraethylenepentamine and valeraldehyde.

3. A composition according to claim 1 wherein (a) is a petroleum sulfonic acid prepared by sulfonating a petroleum hydrocarbon fraction having a viscosity within the range of 90 to 270 SUS at 210°F and a viscosity index of at least about 85 and (b) is an adduct formed from tetraethylenepentamine and salicylaldehyde.

4. A composition according to claim 1 wherein (a) is a petroleum sulfonic acid prepared by sulfonating a petroleum hydrocarbon fraction being a viscosity within the range of 90 to 270 SUS at 210°F and a viscosity index of at least about 85 and (b) is an adduct formed from tetraethylenepentamine and p-anisaldehyde.

5. A composition according to claim 1 wherein the amount of (a) present with respect to (b) ranges from 1/1 to 5/1 equivalents of petroleum sulfonic acid per mole of amine used to prepare the adduct of (b), and further wherein the molar ratio of aldehyde to amine is in the range of 1/1 to 2/1.

6. A composition according to the claim 1 wherein said reacting is carried out at a temperature in the range of 100° to 210°F for a period of time ranging from about 0.1 to about 20 hours.

7. A process for the preparation of a lubricating oil and gasoline additive which comprises a. contacting at least one aldehyde having from 2 to 12, inclusive, carbon atoms with at least one amine selected from primary monoamines having from 2 to 10, inclusive, carbon atoms, and polyamines represented by the formula $H_2N[(CH_2)_xNH]_yH$ wherein $X$ is an integer of from 2 to 6 and $y$ is an integer of from 1 to 10, under conditions of a temperature and pressure and for a time sufficient to produce an aldehyde/amine adduct of said compounds, the molar ratio of aldehyde to amine present during said contacting being about 1/1 to about 2/1, and b. interreacting at a temperature and pressure and for a time sufficient to produce said additive said adduct obtained in step (a) with a petroleum sulfonic acid wherein the amounts of reactants present during said reacting are from 1/1 to 5/1 equivalents of petroleum sulfonic acid per mole of amine used to prepare said adduct.

8. A process according to claim 7 wherein the aldehyde is slowly added to said amine while cooling the reaction mixture during said contacting in step (a), and then the reaction mixture is refluxed at an elevated temperature to complete the reaction and remove some of the water formed during the reaction.

9. A process according to claim 8 wherein the reactants during the formation of said adduct are cooled to about 0°F and then heated up to about 350°F to complete the reaction.

10. A process according to claim 8 wherein said interreacting is carried out in the presence of an inert diluent and at a temperature in the range of 100° to 200°F for a period of time sufficient to form said product additive.

* * * * *